US005401200A

United States Patent [19]

Ellis

[11] Patent Number: 5,401,200

[45] Date of Patent: Mar. 28, 1995

[54] BABY BOTTLES FORMED OF SEPARABLE SEGMENTS ADAPTED TO EDUCATE AND ENTERTAIN A CHILD DURING FEEDING

[76] Inventor: Ingrid M. Ellis, 1358 Teller Ave., Bronx, N.Y. 10456

[21] Appl. No.: 177,147

[22] Filed: Jan. 4, 1994

[51] Int. Cl.[6] ..... A63H 33/04; A63H 33/08

[52] U.S. Cl. ..... 446/71; 446/89; 446/117; 446/124; 220/4.27

[58] Field of Search ..... 446/71, 73, 74, 85, 446/89, 117, 304, 475, 124; 215/11.1; 220/4.26, 4.27

[56] References Cited

U.S. PATENT DOCUMENTS

| | | | |
|---|---|---|---|
| 247,302 | 9/1881 | Candy | 446/71 |
| 1,434,460 | 11/1922 | Tibbatts | 215/11.1 |
| 1,701,566 | 2/1929 | Havins | 215/11.1 |
| 2,326,414 | 8/1943 | Thompson | 220/4.26 |
| 2,571,744 | 10/1951 | Midouhas | 446/73 |
| 2,926,805 | 3/1960 | Mead | 215/11.1 |
| 3,488,880 | 1/1970 | Taylor | 446/85 |
| 3,518,786 | 7/1970 | Holtvoigt | 446/85 |
| 4,778,068 | 10/1988 | Kohus | 215/11.1 |
| 5,078,287 | 1/1992 | Holmes, III | 215/11.1 |

FOREIGN PATENT DOCUMENTS

| | | | |
|---|---|---|---|
| 746707 | 11/1966 | Canada | 215/11.1 |
| 2543565 | 4/1977 | Germany | 446/117 |
| 195805 | 6/1938 | Switzerland | 220/4.26 |

*Primary Examiner*—Robert A. Hafer
*Assistant Examiner*—Jeffrey D. Carlson

[57] ABSTRACT

A baby bottle formed of separable segments each adapted to educate and entertain a child during feeding comprising a plurality of hollow, generally cube-shaped blocks matable together to form a baby bottle, each of the blocks having four generally; the blocks including an uppermost block having at its upper extent screw threads, with a nipple and nipple support cap with internal threads removably mounted to the threads of the uppermost block; the blocks also including a lowermost block being formed with a lower end cap secured at its edges to the lowermost edges of the side walls thereof; the blocks also including at least one intermediate block, with each intermediate block being formed with an axial flange and external O-ring at its upper end and an internal circular flange adapted to be received over the flange and O-ring of an adjacent block; and an alpha-numeric character formed on at least one side wall of each block and an associated illustration of an object.

4 Claims, 4 Drawing Sheets

Fig. 5
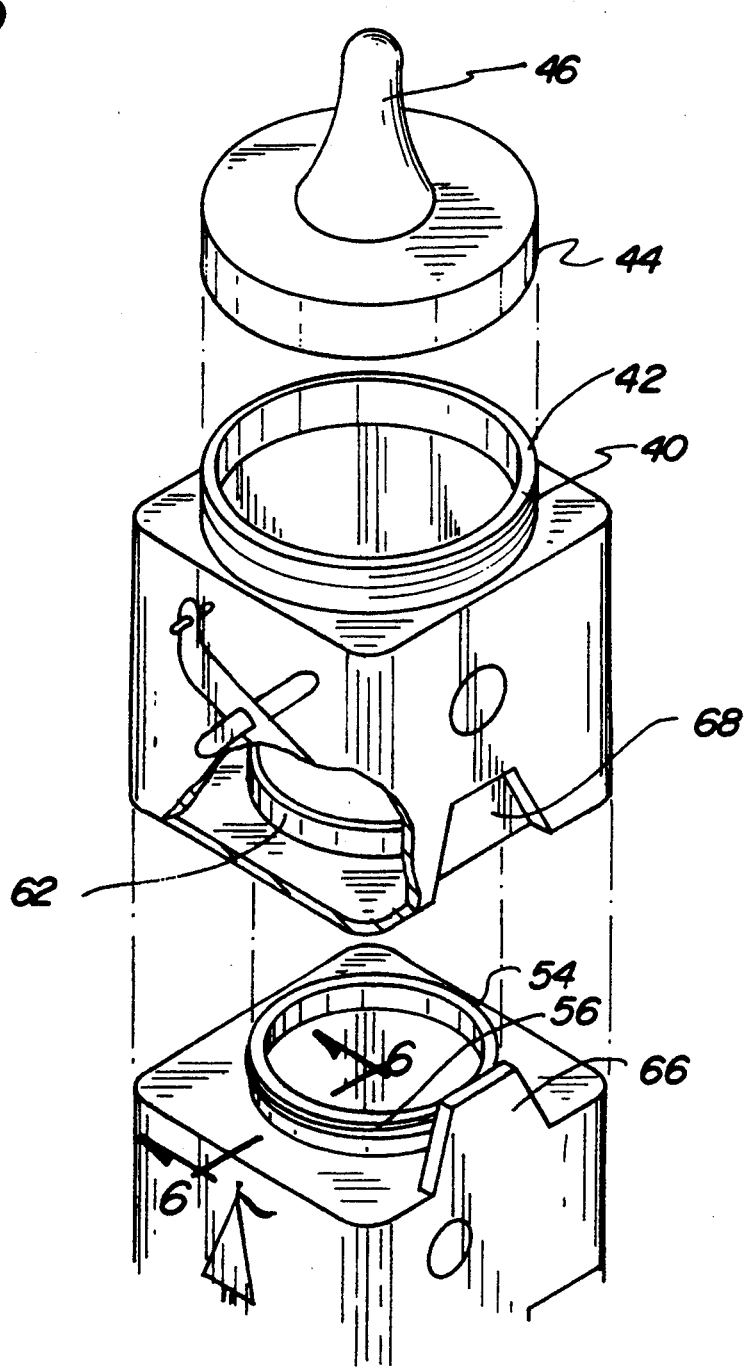
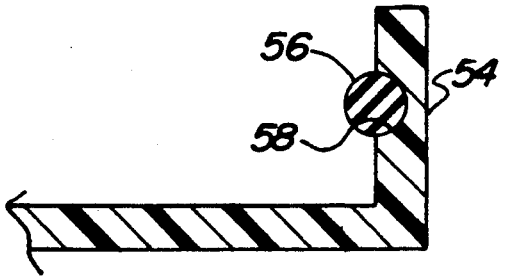
Fig. 6

BABY BOTTLES FORMED OF SEPARABLE SEGMENTS ADAPTED TO EDUCATE AND ENTERTAIN A CHILD DURING FEEDING

BACKGROUND OF THE INVENTION

1. Field of the Invention

The present invention relates to baby bottles formed of separable segments adapted to educate and entertain a child during feeding and more particularly pertains to educating and entertaining children during feeding through a baby bottle comprised of a plurality of segments each segment adapted to individually achieve the intended plurality of functions.

2. Description of the Prior Art

The use of baby bottles is known in the prior art. More specifically, baby bottles heretofore devised and utilized for the purpose of feeding a child while educating and/or entertaining the child are known to consist basically of familiar, expected, and obvious structural configurations, notwithstanding the myriad of designs encompassed by the crowded prior art which has been developed for the fulfillment of countless objectives and requirements.

The prior art discloses a large number of baby bottles. By way of example, U.S. Pat. No. 3,496,652 to Wolfner discloses a bottle toy.

U.S. Pat. No. 4,570,808 to Campbell discloses a baby bottle with integral handle.

U.S. Pat. No. 4,832,213 to Sharon discloses a baby bottle employing a curved shape along its length.

U.S. Pat. No. 4,940,153 to Pilgrim, Jr. discloses a decorative bottle and method of fabricating.

Lastly, U.S. Pat. No. 4,944,418 to Wallace discloses a soft baby bottle.

In this respect, baby bottles formed of separable segments each adapted to educate and entertain a child during feeding according to the present invention substantially depart from the conventional concepts and designs of the prior art, and in doing so provide an apparatus primarily developed for the purpose of educating and entertaining children during feeding through a baby bottle comprised of a plurality of segments each segment adapted to individually achieve the intended plurality of functions.

Therefore, it can be appreciated that there exists a continuing need for new and improved baby bottles formed of separable segments each adapted to educate and entertain a child during feeding which can be used for educating and entertaining children during feeding through a baby bottle comprised of a plurality of segments each segment adapted to individually achieve the intended plurality of functions. In this regard, the present invention substantially fulfills this need.

SUMMARY OF THE INVENTION

In view of the foregoing disadvantages inherent in the known types of baby bottles now present in the prior art, the present invention provides improved baby bottles formed of separable segments each adapted to educate and entertain a child during feeding. As such, the general purpose of the present invention, which will be described subsequently in greater detail, is to provide new and improved baby bottles formed of separable segments each adapted to educate and entertain a child during feeding and methods which have all the advantages of the prior art and none of the disadvantages.

To attain this, the present invention essentially comprises a new and improved baby bottle formed of separable segments each adapted to educate and entertain a child during feeding comprising, in combination, a plurality of hollow, generally cube-shaped blocks matable together to form a baby bottle, each of the blocks having four generally square side walls coupled together at their edges to form an essentially square cross-sectional configuration with a longitudinal axis extending through the center thereof. The blocks include an uppermost block having at its upper extent screw threads, with a nipple and nipple support cap with internal threads removably mounted to the threads of the uppermost block. The blocks also include a lowermost block being formed with a lower end cap in a square configuration secured at its edges to the lowermost edges of the side walls thereof. The blocks also include at least one intermediate block, with each intermediate block being formed with an axial flange and external O-ring at its upper end and an internal circular flange adapted to be received over the flange and O-ring of an adjacent block. An alpha-numeric character is formed on at least one side wall of each block and an associated illustration of an object beginning with such alpha-numeric character on an associated side wall, one component of the alpha-numeric character of one block being physically interrelated with the next adjacent block. A transparent window of a rectangular configuration positioned within a rectangular recess formed within one side wall of each block, with a space between the recess and window for the receipt of a pre-selected picture for viewing through the window. A rectangular recess is formed within the bottom face of the bottommost block with a supplemental rectangular window in a rectangular configuration positioned therein with a space therebetween for the positioning of a picture for being viewed through the supplemental window.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved baby bottles formed of separable segments each adapted to educate and entertain a child during feeding which have all the advantages of the prior art baby bottles and none of the disadvantages.

It is another object of the present invention to provide new and improved baby bottles formed of separable segments each adapted to educate and entertain a child during feeding which may be easily and efficiently manufactured and marketed.

It is a further object of the present invention to provide new and improved baby bottles formed of separable segments each adapted to educate and entertain a child during feeding which are of a durable and reliable construction.

An even further object of the present invention is to provide new and improved baby bottles formed of separable segments each adapted to educate and entertain a child during feeding which are susceptible of a low cost of manufacture with regard to both materials and labor, and which accordingly are then susceptible of low prices of sale to the consuming public, thereby making such baby bottles formed of separable segments each adapted to educate and entertain a child during feeding economically available to the buying public.

Still yet another object of the present invention is to provide new and improved baby bottles formed of separable segments each adapted to educate and entertain a child during feeding which provide in the apparatuses and methods of the prior art some of the advantages thereof, while simultaneously overcoming some of the disadvantages normally associated therewith.

Even still another object of the present invention is to educate and entertain children during feeding through a baby bottle comprised of a plurality of segments each segment adapted to individually achieve the intended plurality of functions.

Lastly, it is an object of the present invention to provide new and improved baby bottles formed of separable segments each adapted to educate and entertain a child during feeding comprising a plurality of hollow, generally cube-shaped blocks matable together to form a baby bottle, each of the blocks having four generally square side walls coupled together at their edges to form an essentially square cross-sectional configuration with a longitudinal axis extending through the center thereof; the blocks including an uppermost block having at its upper extent screw threads, with a nipple and nipple support cap with internal threads removably mounted to the threads of the uppermost block; the blocks also including a lowermost block being formed with a lower end cap in a square configuration secured at its edges to the lowermost edges of the side walls thereof; the blocks also including at least one intermediate block, with each intermediate block being formed with an axial flange and external O-ring at its upper end and an internal circular flange adapted to be received over the flange and O-ring of an adjacent block; and an alpha-numeric character formed on at least one side wall of each block and an associated illustration of an object beginning with such alpha-numeric character on an associated side wall.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a perspective illustration of the upper portions of the bottle shown in FIGS. 1 and 2.

FIG. 6 is a cross-sectional view taken along line 6—6 of FIG. 5.

The same reference numerals refer to the same parts throughout the various Figures.

DESCRIPTION OF THE PREFERRED EMBODIMENT

Figure 1:
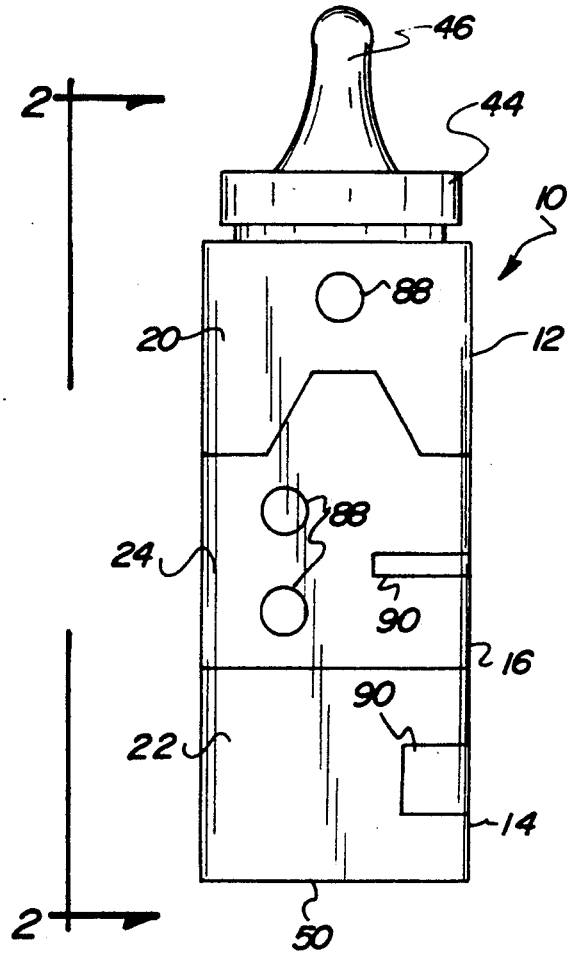
FIG. 1 is a front elevation of the preferred embodiment of the baby bottles formed of separable segments each adapted to educate and entertain a child during the feeding time constructed in accordance with the principles of the present invention.

With reference now to the drawings, and in particular to FIG. 1 thereof, the preferred embodiment of the new and improved baby bottles formed of separable segments each adapted to educate and entertain a child during the feeding time embodying the principles and concepts of the present invention and generally designated by the reference numeral 10 will be described.

Specifically, it will be noted with reference to FIGS. 1 through 6 that the present invention is a new and improved baby bottle 10 formed of separable segments each adapted to educate and entertain a child during feeding. In its broadest context, the bottle 10 includes a plurality of blocks 12, 14, 16, the blocks including an uppermost block 12, a lowermost block 14, and at least one intermediate block 16. Also included is an alpha-numeric character 20, 22, 24 and an illustration 28, 30, 32.

The illustration of each block is correlated with the alpha-numeric character on the same block but on a different face.

More specifically, each block is of a generally cube-shaped configuration and is hollow for containing milk or other fluid to be consumed by the baby. Each of the blocks has four generally square side walls 36. The side walls are coupled together at their edges to form an essentially square cross-sectional configuration. Note FIGS. 3 and 4. Each block, whether taken alone or when coupled with respect to other blocks, has a central longitudinal axis extending through the center thereof.

The blocks of the bottle 10 include one uppermost block 12. The uppermost block has, at its upper extent, screw threads 40. The screw threads 40 are on an upwardly extending axial flange 42 in a cylindrical configuration. The threads 40 of the flange 42 are adapted to removably receive a nipple support cap 44 with internal screw threads matable with the threads 40 of the flange 42. Support cap 44 receives at its central aperture a nipple 46 in the conventional manner.

Another of the blocks is the lowermost block 14. The lowermost block is formed with a lower end cap 50. Such end cap 50 is of a square configuration and is secured at its edges to the lowermost edges of the side walls 36 of the lowermost block 14.

Figure 2:
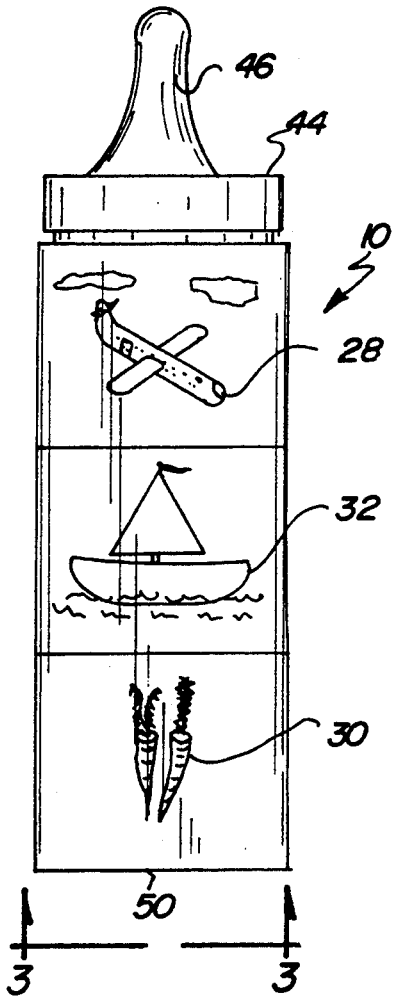
FIG. 2 is a side elevational view of the bottle shown in FIG. 1 taken along line 2—2 of FIG. 1.
Figure 3:
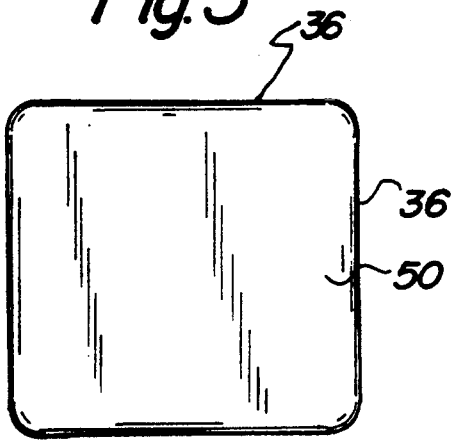
FIG. 3 is a bottom view of the bottle shown in FIGS. 1 and 2.
Figure 4:
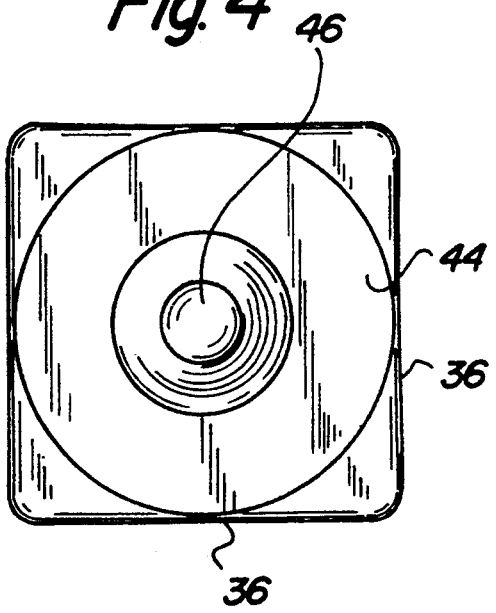
FIG. 4 is a top plan view of the baby bottle shown in FIGS. 1 and 2.

Also formed as part of the bottle is at least one intermediate block 16. Only one such intermediate block is shown in FIGS. 1 and 2. Any number of intermediate blocks 16 could, however, be utilized as a function of the quantity of liquid to be provided in the bottle for being drunk by the child at feeding time. Each intermediate block is formed with an axial flange 54. Each such flange is provided with an elastomeric O-ring 56 functioning to effect a sealing relationship between blocks of the assembled bottle 10. Each of the O-rings 56 is partially received in an annular recess 58 formed in the flange 54. A similar flange 54 and O-ring 56 are also formed in the upper extent of the lowermost block of 14.

In association with the flange 54 and O-ring 56 of each intermediate block is an associated flange 62 located at the lowermost extent at each intermediate block and at the lower extent of the uppermost block 12. Such supplemental flange 62 is cylindrical in shape and is adapted to be received over the flange and O-ring of the next adjacent block. A sealing relationship is then formed between the various blocks when an uppermost block 12 and a lowermost block 14 are coupled with or without one or more intermediate blocks 16 therebetween.

Formed on at least one side wall 36 of each block is an alpha-numeric character 20, 22, 24. In FIG. 1, character 20 is the letter A, block 14 has the alpha-numeric character C, the intermediate block 16 is formed with a character 24 in the shape of the letter B. In association therewith on each block is an associated illustration 28, 30, 32 of an object which begins with the alpha-numeric character on the associated side wall 36 of such block. By way of example, the illustration 28 on block 12 is an airplane which begins with the letter A 20 on the same block. The illustration 30 on the block 14 is of a carrot which begins with the letter C. Block 14 has the alpha-numeric C shown as element 22. Similarly, the illustration 32 at the intermediate block 16 is of a boat B beginning with the letter B whereas the intermediate block shown in FIG. 1 is in the shape of a letter B. Any number of objects and letters could be used or interrelated on any bottle.

Figure 7:
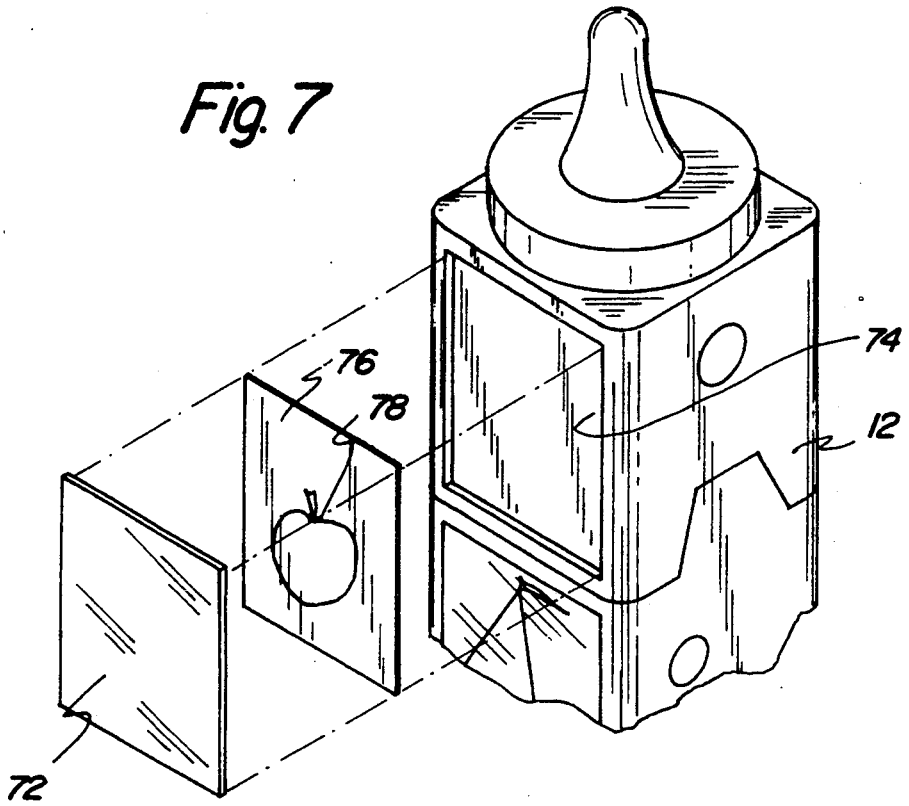
FIG. 7 is a perspective illustration similar to that of FIG. 5 but illustrating an alternate embodiment of the invention.

One further feature of the invention can be seen by reference to FIGS. 1 and 5. In such illustrations, one of the alpha-numeric characters, letter A, is formed with an extension V, the upper part of the letter A which extends into a correspondingly shaped recess 68 on the next adjacent block. This effects a physical interrelationship between one block and the next adjacent block. An alternate embodiment of the invention can be seen in FIGS. 7 and 8. In such embodiments, a transparent window 72 is formed in a rectangular configuration. Such window is removably positionable within a correspondingly shaped rectangular recess 74. Such recess 74 is formed within one side wall 36 of one or blocks. The uppermost block 12 is shown in FIG. 7 for illustrative purposes. A space is thereby formed between the window 72 and the face of the recess 74. Within such recess is positioned a pre-selected picture 76 having an illustration 78 of an object beginning with the letter formed on an adjacent side wall 36 of such block. In FIG. 7, the object 78 is an apple which begins with the letter A wherein the letter A is shaped into the adjacent side wall.

Figure 8:
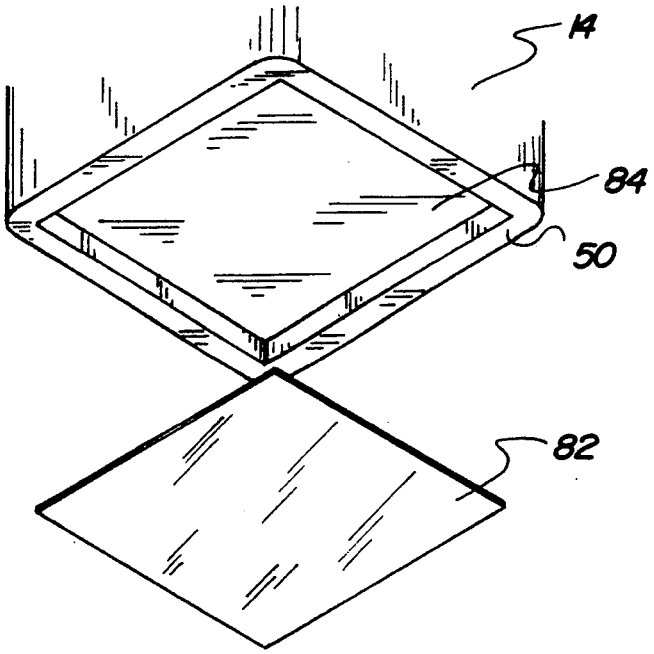
FIG. 8 is a bottom view of the bottle shown in FIG. 6 illustrating another feature of the alternate embodiment of the invention.

Also in association therewith, a supplemental window 82, also of a rectangular configuration, is removably positioned within a recess 84 on the exterior surface of the end cap 50 of the lowermost block 14 as shown in FIG. 8. This lowermost surface of the end cap allows the interchanging of different pictures 76 having an illustration 78 to extend the utility of the bottle for entertainment and educational purposes and to facilitate the feeding of the child. Note is taken that the various blocks include circles 88 and rectangles 90 for use in helping to configure the appropriate side walls into an alpha-numeric configuration. Such circles and rectangles may be painted onto the side walls to effect their function. They also might be formed as recesses within the surfaces of the sidewalls for the same function.

The present invention is easier to hold, and has a shape that is very novel and eye appealing. It makes an ordinary baby bottle an item of unusual interest. Babies bring happiness into the world, and these bottles add to that feeling. They deal with the fundamentals of learning, which are the alphabet and numbers. Children first are taught to count, then they are led slowly into the vast world of the twenty-six letters that comprise our alphabet. Parents and babysitters can amuse the baby by pointing out the shapes and explaining them. While they are not able to comprehend the lessons, the children are fascinated with the conversation they hear. The concept of numbers and letters may be instilled in them almost subliminally.

The present invention is in the shape of three letters of the alphabet, like A, B and C stacked in a column. Other combinations are also provided, as well as bottles which are shaped like numerals, such as 1, 2 and 3. Each section is suitably decorated. A shows an apple, B a banana and C has cherries. Number bottles show 1 object, 2 cookies, 3 plums or other items. All should have happy colors, like rainbows that are light in shades.

This invention fulfills the desires that most people have for something that is different and distinct. There are enough humdrum things in the world that can make days dreary, so something that displays happiness is most welcome. Happiness and babies go hand in hand.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved bottle formed of separable segments each adapted to educate and entertain a child during feeding comprising, in combination:

a plurality of hollow, generally cube-shaped blocks matable together to form a baby bottle, each of the blocks having four generally square side walls unitarily coupled together at their edges to form an essentially square cross-sectional configuration with a longitudinal axis extending through the center thereof;

the blocks including an uppermost block having at its upper extent screw threads, with a nipple and nipple support cap with integral threads removably mounted to the threads of the upper most block;

the blocks also including a lowermost block being formed with a lower end cap in a square configuration unitarily secured at its edges to the lowermost edges of the side walls thereof;

the blocks also including at least one intermediate block, with each intermediate block being formed with an axial flange and external O-ring at its upper end and an internal circular flange adapted to be received over the flange and O-ring of an adjacent block;

an alpha-numeric character formed on at least one side wall of each block and an associated illustration of an object beginning with such alpha-numeric character on an associated side wall, one component of the alpha-numeric character of one block being physically interrelated with the next adjacent block; and a rectangular recess formed within the bottom face of the bottommost block with a supplemental rectangular window in a rectangular configuration positioned therein with a space therebetween for the positioning of a picture for being viewed through the supplemental window.

2. A baby bottle formed of separable segments each adapted to educate and entertain a child during feeding comprising:

a plurality of hollow blocks matable together to form a baby bottle, each block generally formed in a cube shape with an open top, open bottom and four sidewalls having an essentially square cross-sectional configuration with a longitudinal axis extending through the center thereof;

the blocks including an uppermost block having at its upper extent screw threads, with a nipple and nipple support cap with integral threads removably mounted to the threads of the upper most block;

the blocks also including a lowermost block generally formed in a cube shape with an open top, closed bottom face, and four side walls having an essentially square cross-sectional configuration;

the blocks also including at least one intermediate block, with each intermediate block being formed with an axial flange and external O-ring at its upper end and an internal circular flange adapted to be received over the flange and O-ring of an adjacent block; and an alpha-numeric character formed on at least one side wall of each block with one component of the alpha-numeric character of one block extending beyond the block and physically engaging with the alpha-numeric character on the next adjacent block when the blocks are mated and an associated illustration of an object beginning with such alpha-numeric character on an associated side wall.

3. The bottle as set forth in claim 2 and further including:

a transparent window of a configuration positioned within a recess formed within one side wall of each block, with a space between the recess and window for the receipt of a pre-selected picture for viewing through the window; and 4. The bottle as set forth in claim 2 and further including:

a recess formed within the bottom face of the bottommost block with a supplemental window in a configuration positioned therein with a space therebetween for the positioning of a picture for being viewed through the supplemental window.

* * * * *